US011503937B2

(12) United States Patent
Schurr

(10) Patent No.: US 11,503,937 B2
(45) Date of Patent: Nov. 22, 2022

(54) DECORATIVE ARTICLES

(71) Applicant: Linda Schurr, Davidsonville, MD (US)

(72) Inventor: Linda Schurr, Davidsonville, MD (US)

( * ) Notice: Subject to any disclaimer, the term of this patent is extended or adjusted under 35 U.S.C. 154(b) by 0 days.

(21) Appl. No.: 15/588,596

(22) Filed: May 6, 2017

(65) Prior Publication Data

US 2017/0321360 A1 Nov. 9, 2017

Related U.S. Application Data

(60) Provisional application No. 62/333,076, filed on May 6, 2016.

(51) Int. Cl.
*A47H 2/00* (2006.01)

(52) U.S. Cl.
CPC ..... *A47H 2/00* (2013.01)

(58) Field of Classification Search
CPC ..... A47H 2/00; A47H 2/02
USPC ..... 160/330, 38, 39, 12, 126
See application file for complete search history.

(56) References Cited

U.S. PATENT DOCUMENTS 105,355 A * 7/1870 Miller ..... A41H 3/00 33/13
238,527 A * 3/1881 Replogle ..... A47H 2/00 160/38
268,539 A * 12/1882 Rogers ..... A47H 13/00 160/330
297,570 A * 4/1884 Chevinesse ..... A41H 3/00 33/13
778,464 A * 12/1904 Specht ..... A41H 3/00 33/13
1,405,280 A * 1/1922 Cayer ..... E06B 9/52 160/19
1,850,760 A * 3/1932 Mantell ..... B05C 17/06 428/42.1
2,419,407 A * 4/1947 Lepow ..... A47H 23/02 160/330
2,510,502 A * 6/1950 Kress ..... A47H 23/02 160/38
2,537,734 A * 1/1951 Bubeck ..... A47H 23/02 160/123
2,547,697 A * 4/1951 Gallo ..... A47H 19/00 160/330
2,602,500 A * 7/1952 Slavin ..... A47H 2/02 160/38
2,652,267 A * 9/1953 Barbarat ..... A41H 3/02 106/31.01
2,708,711 A * 5/1955 Mcginty ..... F21V 33/0016 160/19
3,134,173 A * 5/1964 Williams ..... A41H 3/06 33/13

(Continued)

*Primary Examiner* — Johnnie A. Shablack
(74) *Attorney, Agent, or Firm* — Edell, Shapiro & Finnan, LLC

(57) ABSTRACT

Embodiments provide methods and systems for designing decorative articles, such as cornice style window valances, wall accents and table accents, and method for making the same. Specifically, the present invention relates to a kit used for making such a decorative article. The kit may include valance panel design forms, such as one side panel valance design form and one or two center panel design forms or one design form for all panels. The kit also includes one or more traceable style form sheets, one or more peel and stick style form sheets and design guide.

18 Claims, 17 Drawing Sheets

(56) References Cited

U.S. PATENT DOCUMENTS 3,181,594 A * 5/1965 Shapiro ..... A47H 23/02 160/124
3,321,004 A * 5/1967 Lopes, Jr. ..... A47H 13/00 160/330
3,545,085 A * 12/1970 Stewart ..... A47H 23/04 156/91
3,652,373 A * 3/1972 Noble ..... A47C 31/023 112/418
3,705,427 A * 12/1972 Schroner ..... A63H 3/52 2/74
3,733,227 A * 5/1973 Collins, Jr. ..... A47H 23/04 156/196
3,765,095 A * 10/1973 Olive ..... A41H 3/04 33/14
3,996,987 A * 12/1976 Rodriguez ..... A47H 2/00 160/19
4,308,572 A * 12/1981 Davidson ..... A41D 27/085 36/137
4,446,642 A * 5/1984 Chap ..... A47K 10/10 248/223.41
4,564,406 A * 1/1986 Binks ..... B44C 1/1733 156/235
4,814,218 A * 3/1989 Shane ..... B44C 3/12 112/439
4,966,793 A * 10/1990 Covell ..... A47G 33/06 362/249.19
5,074,348 A * 12/1991 Phillips ..... A47H 3/02 160/327
5,092,384 A * 3/1992 Easley ..... A47H 1/18 160/126
5,240,758 A * 8/1993 Honigberg ..... A47H 23/06 160/330
5,366,780 A * 11/1994 Rapisarda ..... A41D 27/085 362/103
5,447,770 A * 9/1995 Smith ..... B44C 5/00 156/72
5,477,437 A * 12/1995 Lach ..... G09F 17/00 116/173
5,484,006 A * 1/1996 Walker ..... A47H 2/00 160/19
5,503,209 A * 4/1996 Healzer ..... A47H 2/00 160/38
5,683,769 A * 11/1997 Cheng ..... B65D 67/00 206/466
5,881,471 A * 3/1999 Kaluza ..... A47H 23/04 33/13
5,975,718 A * 11/1999 White ..... F21S 4/10 362/235
6,085,821 A * 7/2000 Roberts ..... A47H 19/00 160/38
6,108,918 A * 8/2000 Ye ..... A47H 23/02 33/12
6,116,752 A * 9/2000 Mayfield ..... A47G 33/06 362/147
6,152,204 A * 11/2000 Santoro ..... A47H 2/00 160/19
6,192,962 B1 * 2/2001 Glover ..... A47H 2/02 160/126
6,352,355 B1 * 3/2002 Law ..... D04D 9/04 362/234
6,398,388 B1 * 6/2002 Lorenzana ..... A47G 33/06 362/240
6,402,336 B1 * 6/2002 Reese ..... F21V 17/007 362/103
6,443,081 B1 * 9/2002 Quint ..... D05B 97/12 112/439
6,488,391 B1 * 12/2002 Gary ..... B44C 3/12 248/150
6,655,439 B2 * 12/2003 Parsonage ..... A47H 23/04 160/348
6,732,783 B2 * 5/2004 Bouldin ..... A47H 23/04 160/348
6,866,082 B1 * 3/2005 Zahner ..... A47K 3/38 160/390
6,877,548 B1 * 4/2005 Chartier ..... E06B 9/36 160/10
6,935,039 B1 * 8/2005 Hess ..... D05B 97/12 33/1 B
7,111,342 B2 * 9/2006 Owens, Jr. ..... A47H 2/00 442/361
7,141,291 B2 * 11/2006 Crow ..... A47H 2/00 428/124
7,192,168 B2 * 3/2007 Day ..... G09F 13/22 362/249.03
7,650,924 B1 * 1/2010 Bouldin ..... A47H 1/00 160/330
7,743,813 B2 * 6/2010 Haffamier ..... A47H 1/022 160/348
7,775,493 B2 * 8/2010 Pilutti ..... B44C 5/02 248/261
7,882,645 B2 * 2/2011 Boring ..... D05C 17/00 33/562
7,935,407 B2 * 5/2011 Chen ..... A47G 33/08 428/12
8,047,256 B2 * 11/2011 Zimmer ..... A47H 13/04 160/124
8,312,910 B2 * 11/2012 Zimmer ..... A47H 1/02 160/110
8,789,574 B2 * 7/2014 Ferguson ..... A47H 2/00 160/38
9,113,739 B2 * 8/2015 Thomas ..... A47H 2/00
9,169,690 B2 * 10/2015 Blair ..... E06B 9/24
9,470,411 B1 * 10/2016 Ramsey ..... A41B 9/00
9,561,707 B1 * 2/2017 Walicki, Sr. ..... B60J 5/0487
9,743,696 B1 * 8/2017 Ramsey ..... A41D 27/085
9,744,472 B2 * 8/2017 DiCiacce ..... B44C 3/12
2002/0007920 A1 * 1/2002 Lower ..... A47H 23/02 160/38
2004/0035534 A1 * 2/2004 Owens, Jr. ..... A47H 2/00 160/38
2004/0069415 A1 * 4/2004 Paraonage ..... A47H 23/04 160/38
2004/0172844 A1 * 9/2004 Murray ..... B26D 7/0006 33/563
2004/0221540 A1 * 11/2004 Simons ..... A47H 2/00 52/716.1
2004/0255807 A1 * 12/2004 Xiong ..... A47H 2/00 101/483
2005/0161169 A1 * 7/2005 Webb ..... A47H 2/00 160/38
2006/0082987 A1 * 4/2006 Dorsey ..... F21V 23/04 362/103
2006/0170156 A1 * 8/2006 Fabrige ..... B44C 3/025 273/157 R
2007/0022681 A1 * 2/2007 Owens ..... A47H 2/00 52/211
2007/0228250 A1 * 10/2007 Pilutti ..... B44C 3/12 248/558
2008/0142170 A1 * 6/2008 Killian ..... E06B 9/36 160/236
2008/0230187 A1 * 9/2008 Caron ..... A47H 2/00 160/38
2008/0248713 A1 * 10/2008 Mulrine ..... A63H 33/006 446/227
2010/0051210 A1 * 3/2010 Daly ..... A47H 2/00 160/113
2010/0181032 A1 * 7/2010 Bennett ..... A47H 2/00 160/330
2010/0215886 A1 * 8/2010 Chen ..... A47G 33/08 428/43
2010/0229408 A1 * 9/2010 Starodoumova ..... A41H 3/06 33/12
2011/0168340 A1 * 7/2011 Squillante ..... A47H 2/00 160/330
2011/0188250 A1 * 8/2011 Waldhuetter ..... F21S 4/26 362/249.05
2011/0284172 A1 * 11/2011 Seitz ..... A47H 13/00 160/123

(56) References Cited

U.S. PATENT DOCUMENTS

| | | | | |
|---|---|---|---|---|
| 2012/0297541 | A1* | 11/2012 | Brown | A47G 9/02 5/490 |
| 2013/0250559 | A1* | 9/2013 | Hawkins | F21V 33/008 362/183 |
| 2014/0262060 | A1* | 9/2014 | VanDervoort | A47H 2/00 160/38 |
| 2017/0095996 | A1* | 4/2017 | Kataoka | C08G 18/792 |
| 2017/0321360 | A1* | 11/2017 | Schurr | A47H 2/00 |
| 2018/0106099 | A1* | 4/2018 | McVey | E06B 9/24 |

* cited by examiner

520

DECORATIVE ARTICLES

FIELD OF THE INVENTION

This invention generally relates to decorative articles and more particularly to window valances and methods of making such home decorative articles.

BACKGROUND

Use of window valances, wall accents and table accents, as home decorative articles are well known. In most cases, such decorative articles are available in a ready to use form i.e. they are non-customizable in nature, however, few decorative articles may be customizable in nature.

Typically, customizable decorative articles are either expensive or may require use of a professional designer. Further, such customizable decorative articles may require sewing various elements together, or may require hiring of a designer to have the individual pieces stitched together. Manually configuring customizable decorative articles requires pattern reading and sizing knowledge as well as sewing skills. Additionally, many home decorative articles such as, for example, home sewn valances are attached to a wood valance board. Therefore, some basic wood crafting skills and knowledge of how to use suitable tools to make the wood valance board is also required. Sometimes, wood valance boards may also be purchased and hung over windows. Alternatively, a user may preclude such a manual effort and instead purchase the premade packaged, which are very limited in style and expansion capabilities and offer an ordinary quality of the finished product.

In view of the above, there exists a need to provide decorative articles that are capable of overcoming the aforementioned drawbacks and providing additional benefits. Further, there exists a need to provide methods of making attractive home decorative articles in an easy and customizable manner.

OBJECT OF INVENTION

The principal object of the embodiments herein is to make decorative articles using a kit that includes several panel design forms in an easy and customizable manner.

Yet another object of the embodiments herein is to create wall accents and table accents that are compatible with multiple design themes.

Yet another object of the embodiments herein is to provide adjustable panels that covers a wide range of window sizes thereby eliminating the need for precise measuring.

SUMMARY

The above-mentioned needs are met by a method of making home decorative articles.

A method for making home decorative articles includes creating one or more of window valance, wall accent and table accent using a kit. The kit is style specific and includes custom panel design forms. Further, the method includes making one or more panels using custom panel design forms to accommodate a particular window size. The panels are associated with the window valance. Furthermore, the method includes assembling the panels. The panels are side panels, center panels and connector panels. The center panels include contrasting fabric with easy to attach trim and fringe.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE VIEWS OF DRAWINGS

In the accompanying figures, similar reference numerals may refer to identical or functionally similar elements. These reference numerals are used in the detailed description to illustrate various embodiments and to explain various aspects and advantages of the present disclosure.

Figure 1:
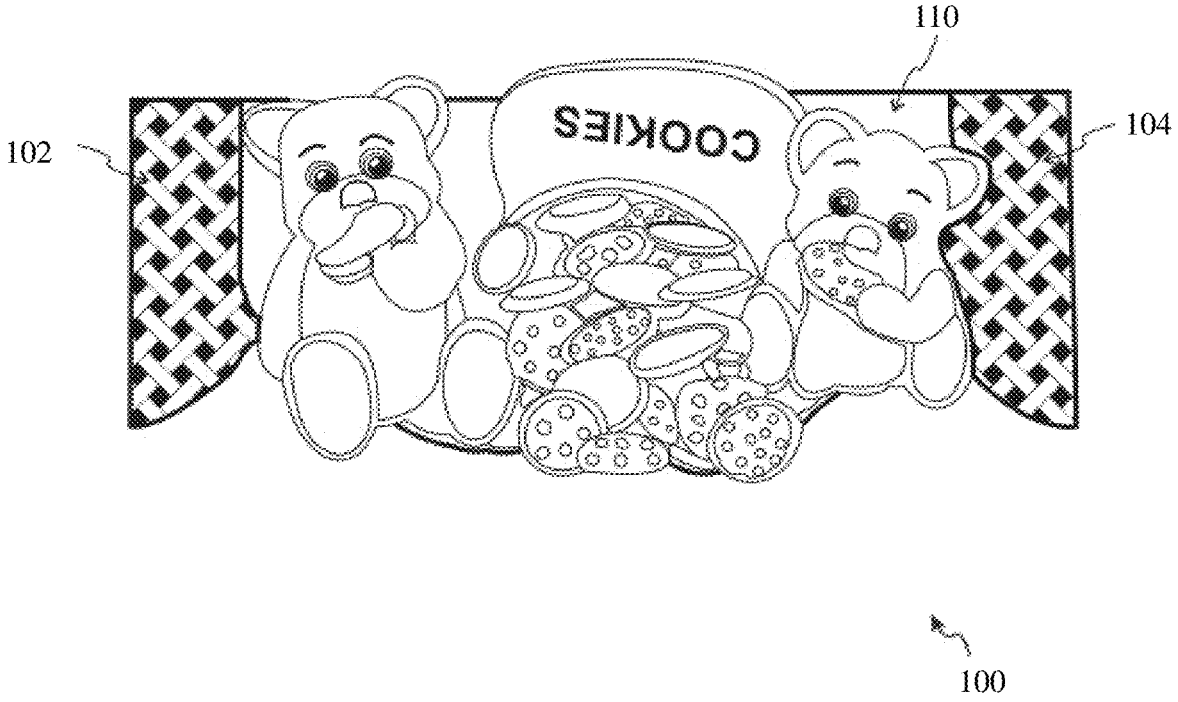
FIG. 1 shows a front view of an example decorative article, in accordance with an embodiment of the present invention.

The drawings referred to in this description are not to be understood as being drawn to scale except if specifically noted, and such drawings are only exemplary in nature.

DETAILED DESCRIPTION OF THE EMBODIMENTS

The above-mentioned needs are met by making home decorative articles. The following detailed description is intended to provide example implementations to one of ordinary skill in the art, and is not intended to limit the invention to the explicit disclosure, as one or ordinary skill in the art will understand that variations can be substituted that are within the scope of the invention as described.

The best and other modes for carrying out the present invention are presented in terms of the embodiments, herein depicted in FIGS. 1 to 6E. The embodiments are described herein for illustrative purposes and are subject to many variations. It is understood that various omissions and substitutions of equivalents are contemplated as circumstances may suggest or render expedient, but are intended to cover the application or implementation without departing from the spirit or the scope of the present invention. Further, it is to be understood that the phraseology and terminology employed herein are for the purpose of the description and should not be regarded as limiting. Any heading utilized within this description is for convenience only and has no legal or limiting effect. The terms "a" and "an" herein do not denote a limitation of quantity, but rather denote the presence of at least one of the referenced item.

The present invention generally relates to decorative articles and methods of making decorative articles. In one embodiment, the present invention provides a kit used for making a decorative article. In an example embodiment, the kit may include valance panel design forms, packed depending on the style: one side panel valance design form and one or two center panel design forms (large and small or one used for all sizes) or one design form for all panels. The kit also includes one or more traceable style form sheets, one or more peel and stick style form sheets and a design guide. The kit may optionally include a scissor, a pencil, pins, a tape measure, a glue gun and/or a glue stick.

In a preferred embodiment, the maximum width and height for design forms is 22" to accommodate packaging purposes.

Typically, the kit is designed with two distinct styles namely, the "Ultimate Valance Making Tool Kit" and the "Children's Room Theme Design Kit". The "Ultimate Valance Making Tool Kit" includes three traditional styles, namely, scalloped, arched and straight. Further, three scalloped design forms, two arched design forms, one straight design form and a custom valance design guide is also included in the kit. The style forms for creating themed traditional decorative accents are packaged separately as enhancements for the scalloped, arched and straight styles. Further, the transfigure design form may be used without the style forms when converting themed fabrics such as Disney sheets, pillow cases, baby blankets and so on. In some embodiments, the transfigure design form may also be included in the ultimate valance making tool kit.

Further, the design forms mentioned above are made from a firm semi-translucent paper or plastic material that is firm enough to be traced around the edges. Specifically, reusable tools are used for creating custom window valances, wall accents and table accents that do not require sewing. No-sew tools are used to trace the panels. The sizing markers are minimal. Sizing is achieved by sliding the design form to the desired sizing marker and tracing around the form to create the panel.

FIG. 1 shows a front view of an example home decorative article, such as a window valance 100, in accordance with an embodiment of the present invention. As shown, the window valance 100 includes a plurality of panels, such as a pair of side panels 102 and 104, and a center panel 110. The side panels 102, 104 and the center panel 110 are collectively referred to herein as panels.

The panels are made using custom panel design forms. For example, the custom panel design forms are positioned on an edge of prepared fabric and traced around the edges to create the panel style (or design). The panels are then cut out and opened. It may be evident that any number of panels may be made to accommodate a particular window size. In an example embodiment, sizing markers for adjustment of sizes of the panels may be located on the design forms used to create different size panels. As mentioned above, the panels may be side panels 102, 104, and the center panel 110. Additionally, the panels may include connector panels and double layered contrast panels. The connector panels may be used to adjoin two or more center panels, such as center panel 110.

In an embodiment, a valance of the present invention, such as 100, may be made of various styles (or design). For example, the valance styles may include a scalloped style, an arched style, a straight style or a transfigure style. It may be evident that in such instances each kit may be style specific and may include corresponding custom panel design forms. These styles allow creating valance panels that link together by overlapping the panels. Each valance panel style has been specifically designed to overlap and expand to accommodate the window width without compromising the design style. Additionally, the design form styles are created to be interchangeable. The overlapping panel designs can be mixed and matched to create additional styles. For example, the arched side panel can be used with the straight center panel or the scalloped center panel can be used with the straight side panel and so on. Finally, a standard wide pocket rod is used to hang the valance panels, for example, hook and loop tape is attached to the panels and the valance rod for hanging, which will be explained in greater detail later.

As mentioned above, the four different valance styles include a scalloped style, an arched style, a straight style and a transfigure style. FIG. 1 shows a transfigure design, which is generally used for making children's window and wall accents. Each valance style includes 1 to 3 design forms needed to create the window valance.

Figure 2A:
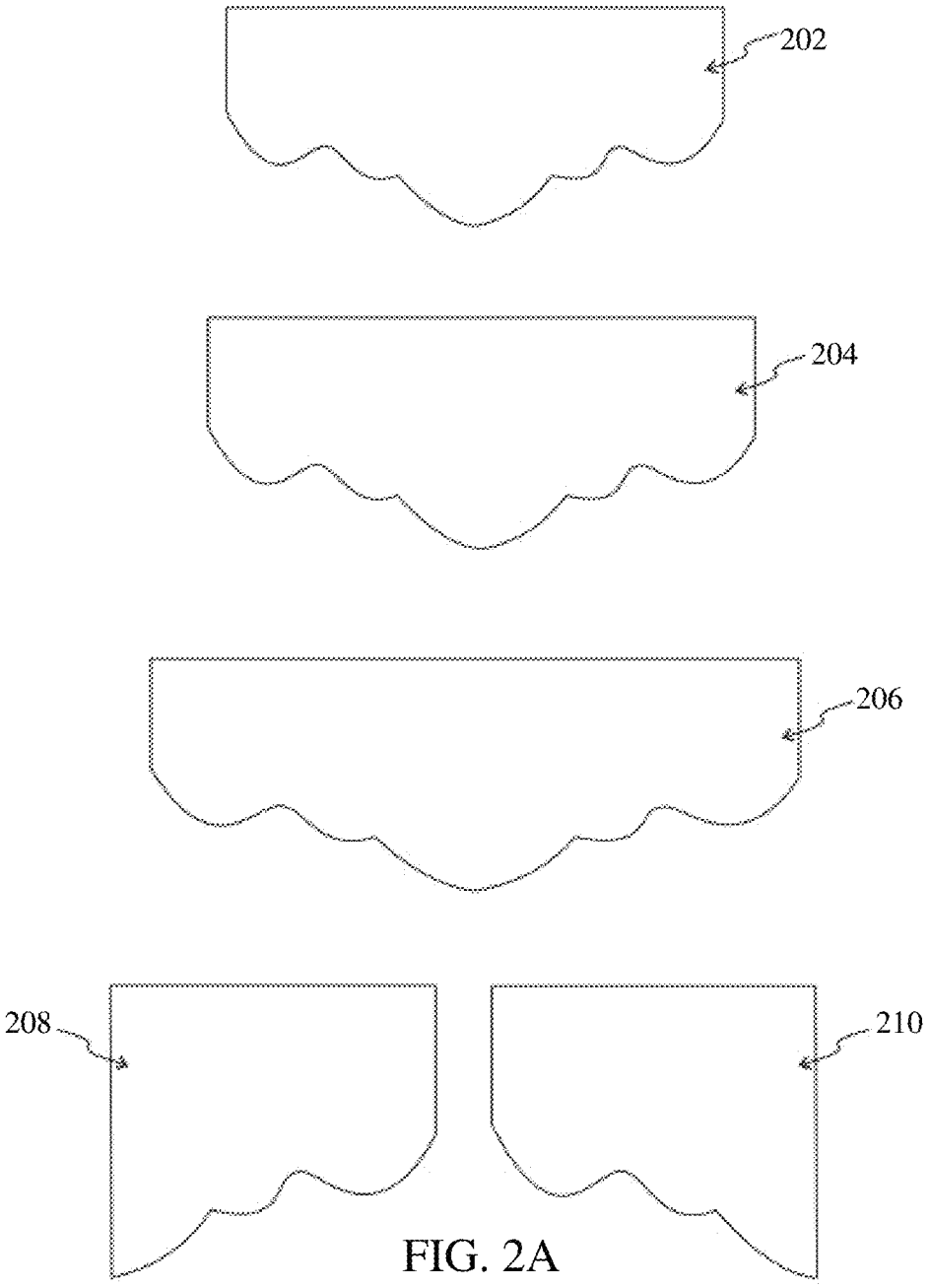
FIGS. 2A-2C show various aspects associated with a scalloped window valance style, in accordance with an embodiment of the present invention.
Figure 2B:
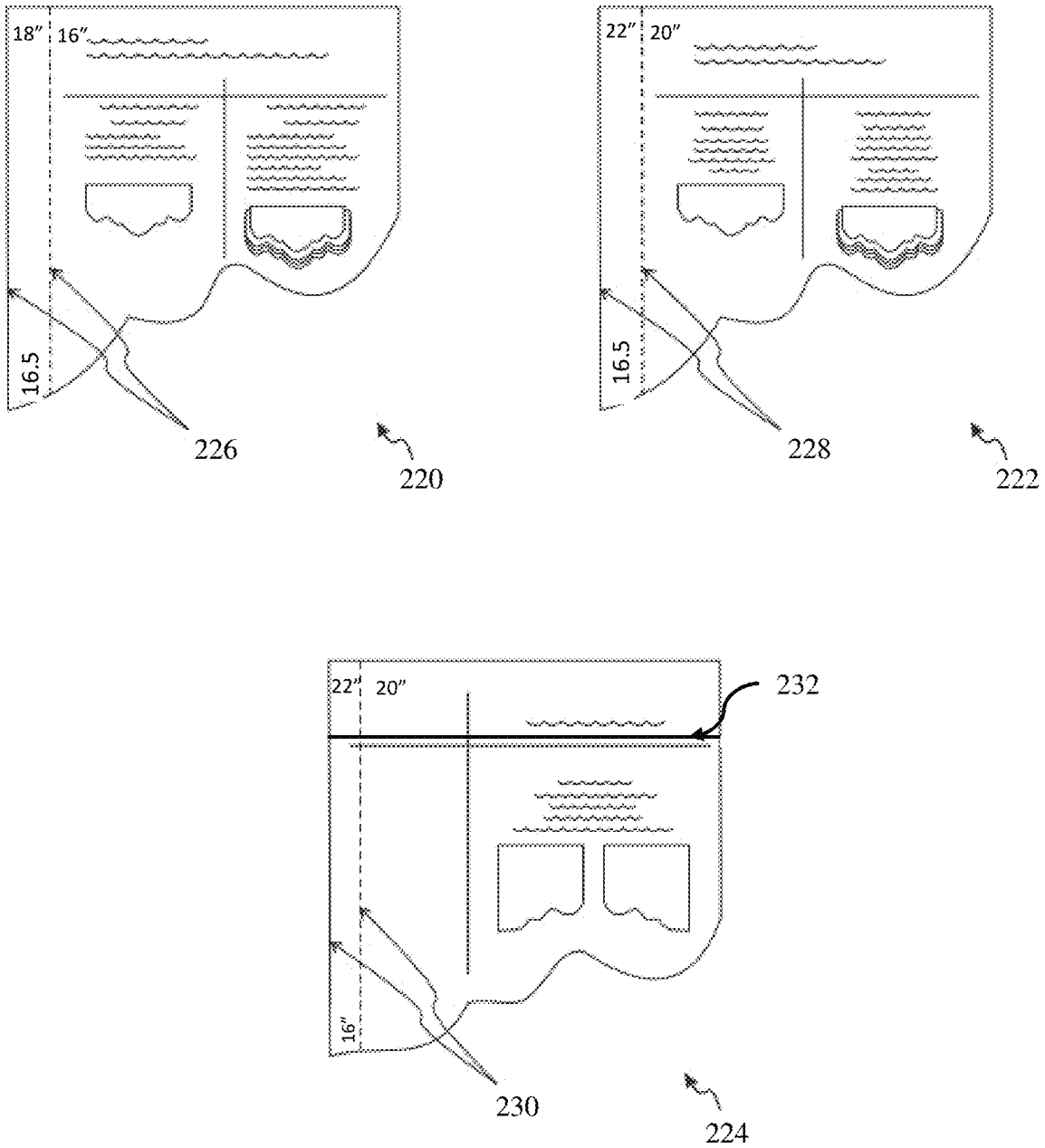
Figure 2C:
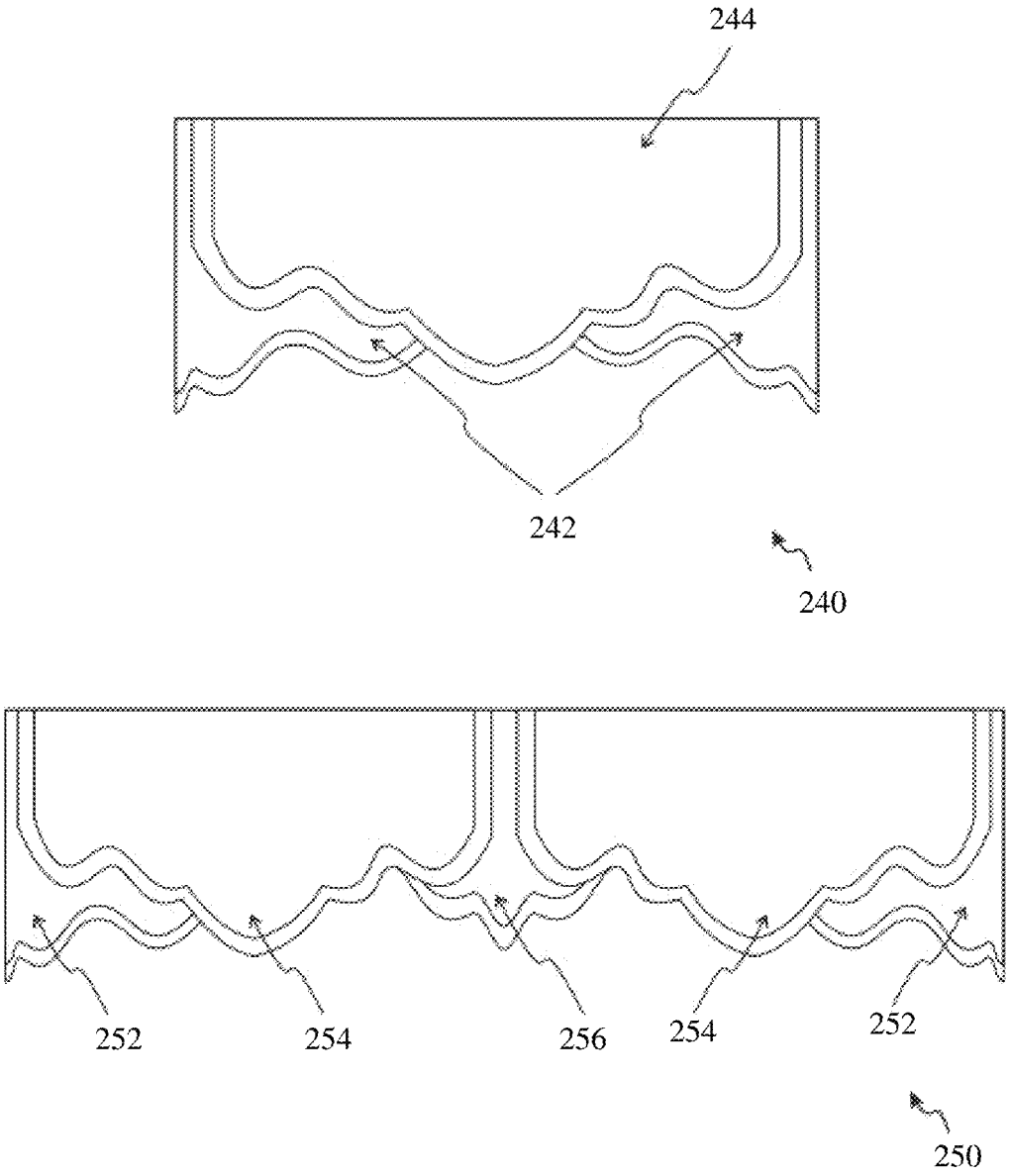

Referring now to FIGS. 2A-2C, various aspects associated with a scalloped window valance style are shown. Specifically, FIG. 2A shows various example designs (or types) of panels used in a scalloped window valance; FIG. 2B shows various example types of design (or style) forms used for making the panels of the FIG. 2A; and FIG. 2C shows various example scalloped window valances made using panels of the FIG. 2A.

Typically, the scalloped valance design style uses a full-size center panel to connect multiple center panel that can either be positioned behind or on the top of center panels.

As shown in FIG. 2A, the various panels (used for making the scalloped window valance) includes a panel connector 202 having a size of 32"×16.5", a small center panel 204 having a size of 36"×16.5", a large center panel 206 having a size of 44"×16.5", and side panels 208 and 210 having sizes of 22"×22" and 22"×20", respectively. In an example, the side panels 208, 210 (used for making the scalloped window valance) may be configured to have a height of 23". Further, the height 22" allows for 6" of fabric to be rolled and secured to create a rod pocket for hanging the panel. Once the pocket has been created, the hung side panel height is 16".

The scalloped window valance may be made using three design forms, such as one side panel form, one small center panel design form and one large center panel design form. As shown in FIG. 2B, a design form 220 is associated with (or used for making) the panel connector 202 and the small center panel 204. Further, a design form 222 is associated with (or used for making) the large center panel 206. Moreover, a design form 224 is associated with (or used for making) the side panels 208 and 210.

As shown, each design form 220, 222, 224 include panel sizing markers 226, 228 (sizing markers are 22" wide and 20" wide) and 230 (sizing markers are 22" wide and 20" wide×22" tall), respectively. It is to be understood that a kit associated with scalloped design includes sizing markers for panel sizing, and instructions are printed on the design forms. The scalloped design includes sizing markers for two side panel sizes 22" and 20". The two center panel sizes are 36" and 44". The small center panel is created by using the outside 18" sizing marker. Further, a contrast panel fabric panel may be created by using the 16" sizing marker. In addition to creating a small contrast panel, the 16" sizing marker may be also used to create "extra small" center panels or a connector panel used to adjoin two or more center panels. Further, the side panel design form includes a lining marker 232 for roll top pocket creation 16" top marker. The form height is 22"

Referring now to FIG. 2C, scalloped window valances 240 and 250 are shown. As shown the scalloped window valances 240, 250 include a plurality of panels, such as side panels, center panels and connector panels. For example, the scalloped window valance 240 includes a pair of side panels 242 and a center panel 244 adjoining the side panels 242. Similarly, the scalloped window valance 250 includes a pair of side panels 252, a pair of center panels 254 and a connector panel 256. It may be evident that scalloped window valances, such as the scalloped window valances 240, 250, may include any number of panels (side panels, center panels and connector panels) to accommodate a particular window size.

Figure 3A:
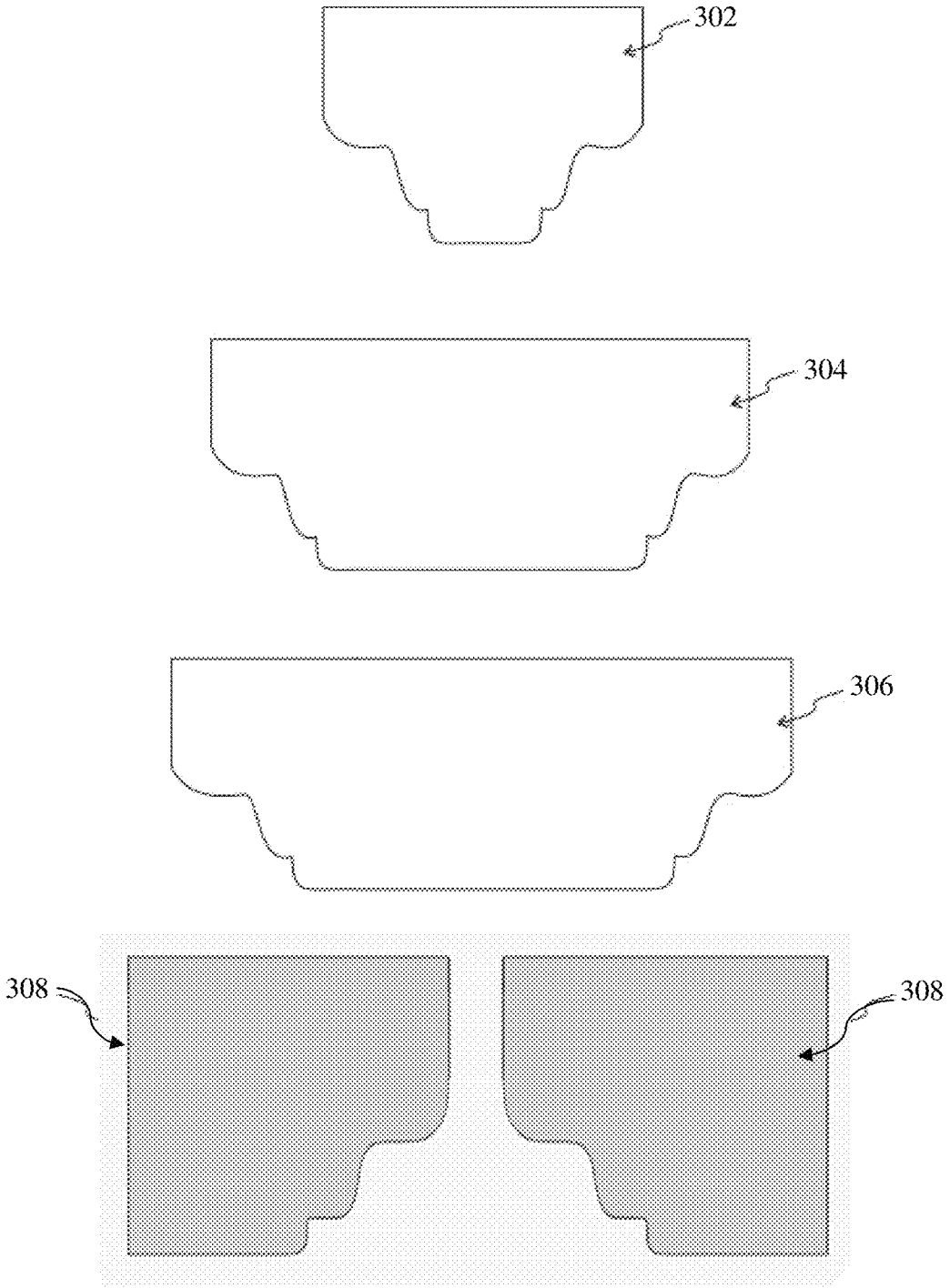
FIGS. 3A-3C show various aspects associated with an arched window valance style, in accordance with an embodiment of the present invention.
Figure 3B:
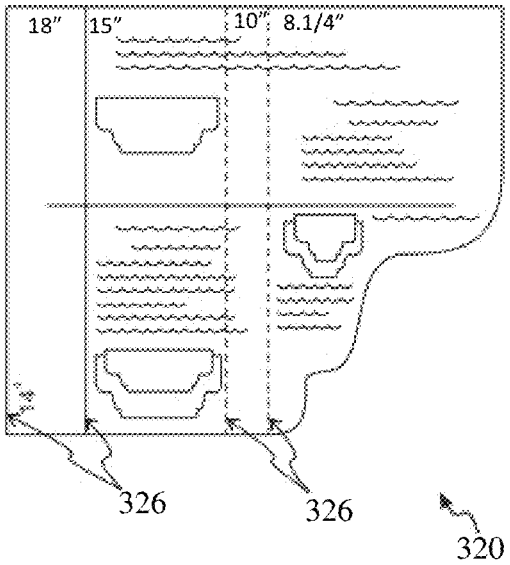
Figure 3B:
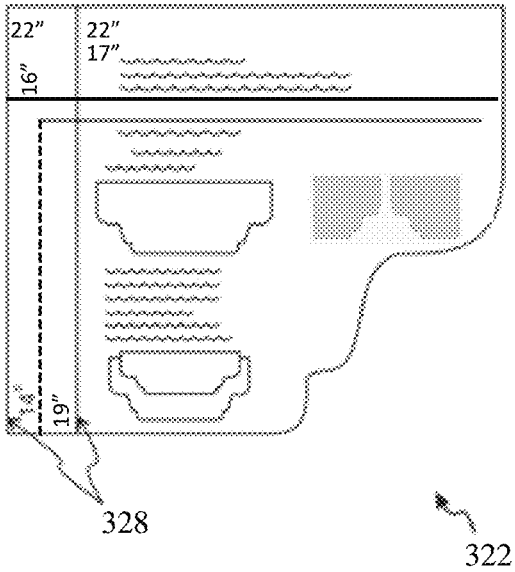
Figure 3C:
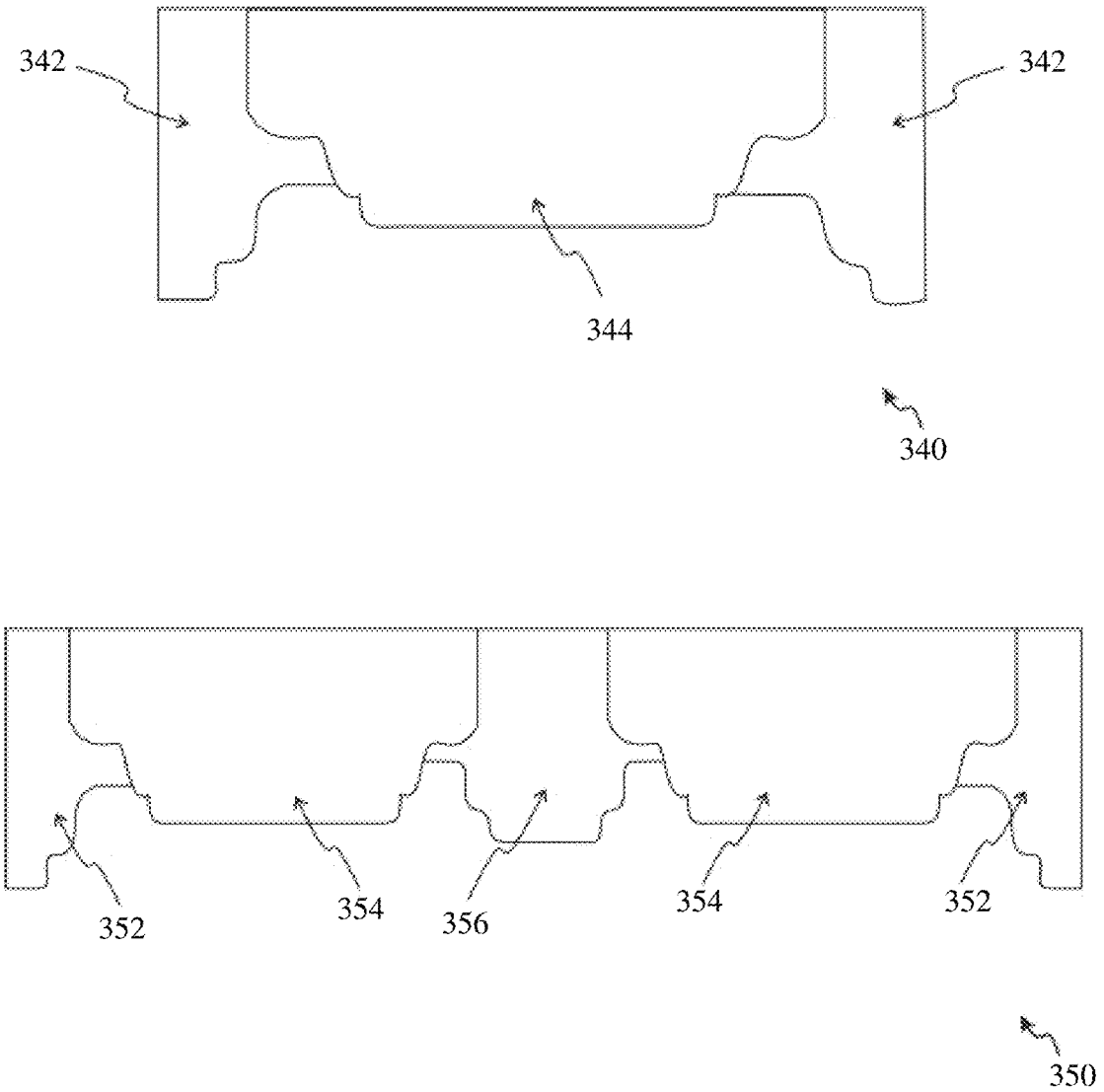

Referring now to FIGS. 3A-3C, various aspects associated with an arched window valance style are shown. Specifically, FIG. 3A shows various example designs (or types) of panels used in an arched window valance; FIG. 3B shows various example types of design (or style) forms used for making the panels of the FIG. 3A; and FIG. 3C shows various example arched window valances made using panels of the FIG. 3A.

The arched valance design style includes sizing markers for creating a mini connector panel. A full-size center panel or a mini connector panel is used to adjoin center panels. The connector panels can be positioned behind or on top of center panels. Alternatively, the connector panels may also be used as overlapping center panels.

As shown in FIG. 3A, the various panels (used for making the arched window valance) includes a panel connector (large) 302 having a size of 20"×14", a small center panel 304 having a size of 36"×14", a large center panel 306 having a size of 44"×14", and side panels 308, each having a size of 22"×22". Further, the finished panel with rod pocket is 22" wide and 16" tall. Small side panels are 22" tall and 17" wide design for sizing, finished small side panels are 17" wide and 16" tall. In an example, the side panels 308 (used for making the arched window valance) may be configured to have a height of 22".

The arched window valance may be made using two design forms, one side panel (large center panel design form) of 22" tall×22" wide and side panel sizing for large 22"×16" finished panel size and small side panel size—17" wide×16" tall finished size. This design form also includes the large center panel size—22" marker used to create a 44" wide×14" tall finished large center panel" and 19" marker for creating a 38" wide×14" tall contrast inlay panel.

As shown in FIG. 3B, a design form 320 is associated with (or used for making) the panel connector 302 and the small center panel 304. Further, a combination side/large center panels design form 322 is also illustrated.

As shown, the design form 320 includes panel sizing markers 326. The design forms 320 and the combination design form include markers 328 for a contrasting center fabric panel. The small arched design form includes markers for creating smaller connector panels used to adjoin two or more center panels. This connector panel can also be created with a contrasting fabric panel. The 10" marker is used to create connector panel and the 8.1/4" marker is used to create the contrast panel for the connector panel.

Referring now to FIG. 3C, arched window valances 340 and 350 are shown. As shown the arched window valances 340, 350 include a plurality of panels, such as side panels, center panels and connector panels. For example, the arched window valance 340 includes a pair of side panels 342 and a center panel 344 adjoining the side panels 342. Similarly, the arched window valance 350 includes a pair of side panels 352, a pair of connector panels 354 and a center panel 356. It may be evident that arched window valances, such as the arched window valances 340, 350, may include any number of panels (side panels, center panels and connector panels) to accommodate a particular window size.

Figure 4A:
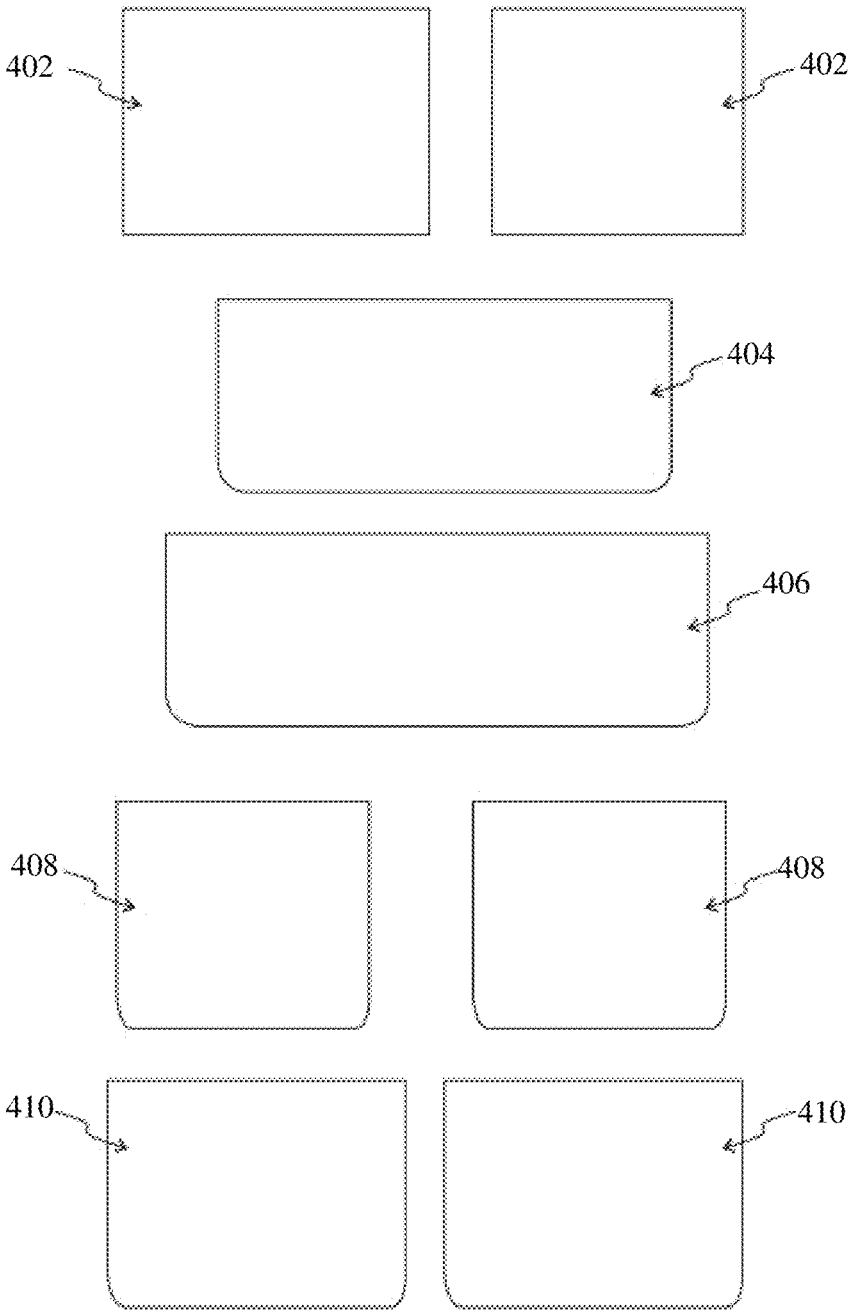
FIGS. 4A-4C show various aspects associated with a straight window valance style, in accordance with an embodiment of the present invention.
Figure 4B:
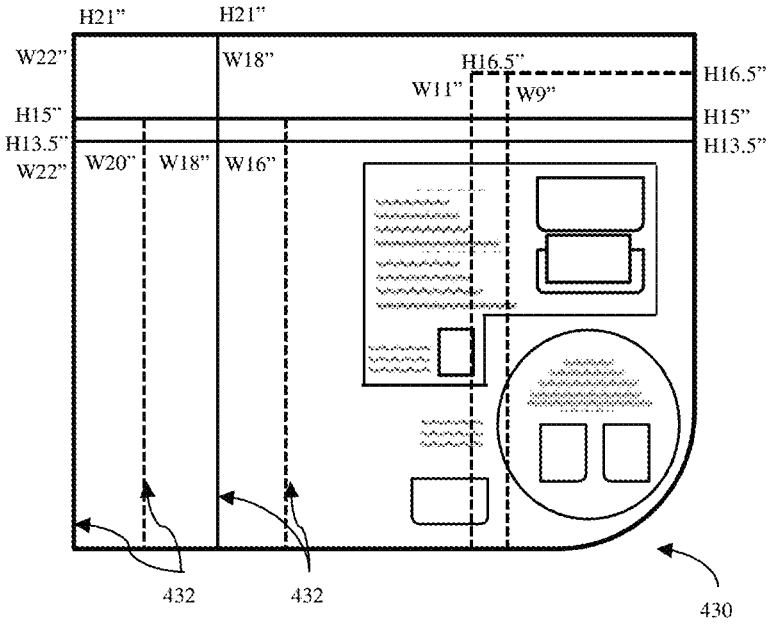
Figure 4C:
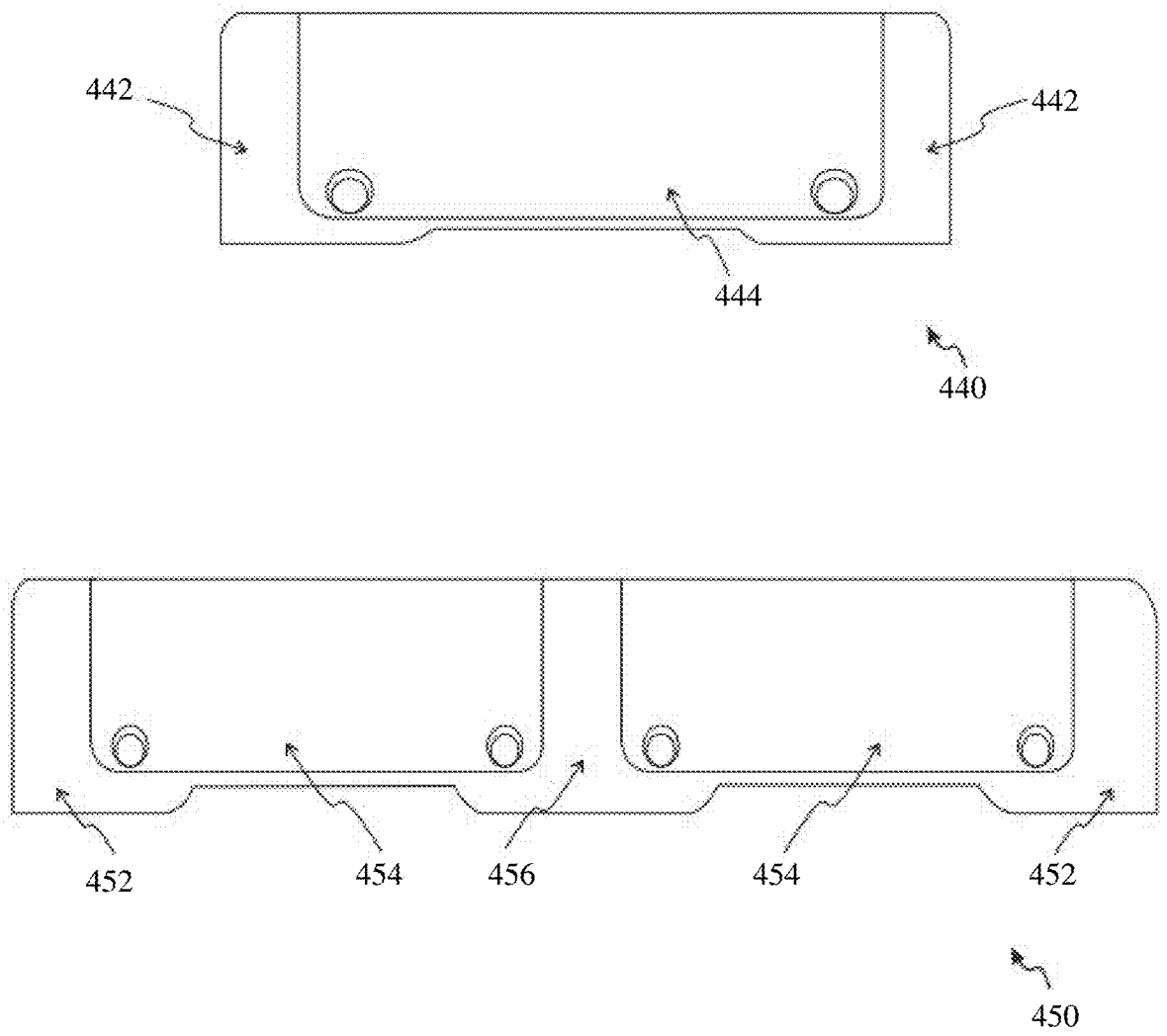

Referring now to FIGS. 4A-4C, various aspects associated with a straight window valance style are shown. Specifically, FIG. 4A shows various example designs (or types) of panels used in a straight window valance; FIG. 4B show various example types of design (or style) forms used for making the panels of the FIG. 4A; and FIG. 4C shows various example straight window valances made using panels of the FIG. 4A.

The straight window valance design style includes sizing markers for creating a mini connector panel. A full-size center panel or a mini connector panel is used to adjoin center panels. Connector panels can be positioned behind or on top of side panels. Further, the center panel design form is used to create small and large center panels as well as, the mini connector panel and all insert panels.

As shown in FIG. 4A, the various panels (used for making the straight window valance) includes panel connectors 402 having a size of 22"×16.5" (large), connector panel having a size of 18"×16.5" (small), a small center panel 404 having a size of 36"×13.5", a large center panel 406 having a size of 44"×13.5", small side panels 408 having size of 18"×15" and large side panels 410 having size of 21"×15" finished with pocket created. The 21" height allows for 6" of fabric needed to create the rod pocket, resulting in 15" tall finished side panels.

The straight window valance may be made using an all-in-one design form used to create all valance panels, large and small side panels, large and small center panels with contrast insert panels, large and small connector panels. The straight style valance design form height is 21" and the width is 22". Detailed sizing of the straight style valance sizing is as follows:

5" minimum panel overlap for small panels with 8" optimal overlap. 7" minimum overlap for large panels with 11" optimal, both with 4" returns.

Referring to FIG. 4B, another design form 430 which is an "all in one" design form is shown. The design form 430 may be used to create all panel sizes including center and side panels, as well as contrast panels and the tapestry style wall accent. Specifically, the design form 430 includes panel sizing markers 432 which enables design form 430 to create all panel sizes. For example, the design form 430 includes a sizing marker used to shorten the center panels.

FIG. 4C shows straight window valances 440 and 450. As shown the straight window valances 440, 450 include a plurality of panels, such as side panels, center panels and connector panels. For example, the straight window valance 440 includes a pair of side panels 442 and a center panel 444 adjoining the side panels 442. Similarly, the straight window valance 450 includes a pair of side panels 452, a pair of center panels 454 and a connector panel 456. It may be evident that straight window valances, such as the straight window valances 440, 450 may include any number of panels (side panels, center panels and connector panels) to accommodate a particular window size.

Figure 5A:
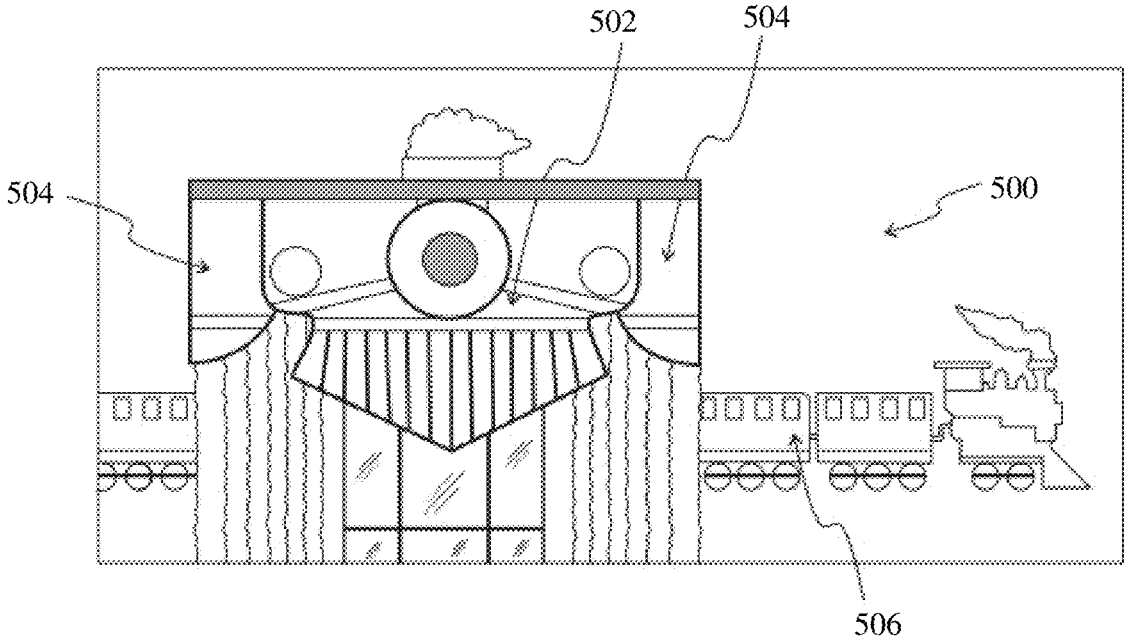
FIGS. 5A-5D and 6A-6E show various aspects associated with a transfigure window valance style, in accordance with an embodiment of the present invention.

Referring now to FIG. 5A, an example transfigure window valance 500 is shown. A transfigure base (such as base explained later with reference to FIG. 5C) is used to create children's valance panels like the transfigure window valance 500. Such a base may also be used to create wall accents as will be explained later. The overlay accents transform the transfigure base into a design, such as the train design.

The transfigure window valance 500 may be packaged along with numbered style forms specific to the designs. In an embodiment, the center panel may be used without side panels when creating a tapestry style wall accent. Specific contrasting fabrics may be layered to create each design. For example, patches are assembled and fused according to a specific number guide for each section. Further, assembled sections are then fused to the base center panel to create the finished designs. Some design themes also call for patches to be attached to the side panels to complete the design. Some transfigure designs such as the train or car, may also include back pockets used to insert lights. These lights are used to enhance the designs by illuminating specific aspects of the design such as car head lights or train lights and so on, also serving as a night light built into the panel. The numbered patches are layered and assembled like a puzzle. Several patches are attached one-at-a-time directly to the base panel, while others are assembled as a cluster and then later, attached. In some embodiments, the patches may also be created using treated fabric that is attached through a peel and stick method (alternative to the fusion method). As shown, all designs extend beyond the panels edges including the top, side and bottom sections to enhance each unique design.

Figure 5B:
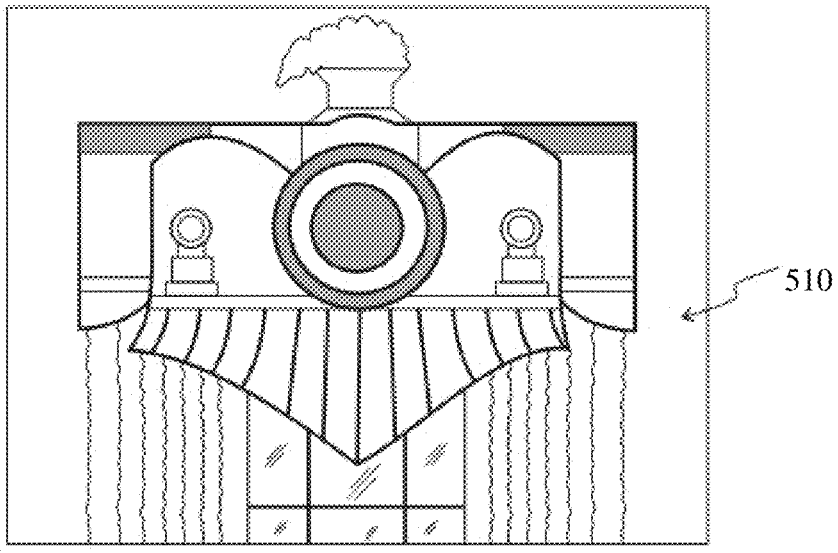

As shown FIG. 5A, the transfigure window valance 500 includes a center panel 502 and side panels 504. Additionally, the transfigure window valance 500 includes peripheral style design forms, such as the mini wall accent 506, which are configured to be attached to wall, on which transfigure window valance 500 is mounted, to provide an overall wall treatment. The mini wall accent 506 is an additional design element included in the kit. The mini wall accents may also be fused to home decorative fabric items such as a clothes hamper or a throw pillow. Typically, mini wall accents are created using a design base style form. Numbered insert patches are created and assembled using the numbered design base as a guide. The completed mini accents are then attached as one unit to the wall or any home decorative fabric item. In some embodiments, the mini wall accents may also be packaged as a stand-alone product. It is noted that separate style forms are used to create the mini wall accents and are not required to complete the design of the window treatment or the full-size wall accent (center panel). A transfigure window valance 510, as shown in FIG. 5B, may not include peripheral style designs (such as the mini wall accent 506). It is understood that the mini wall accents are intended to be used to further enhance the room design theme and can be positioned on any wall.

Figure 5C:
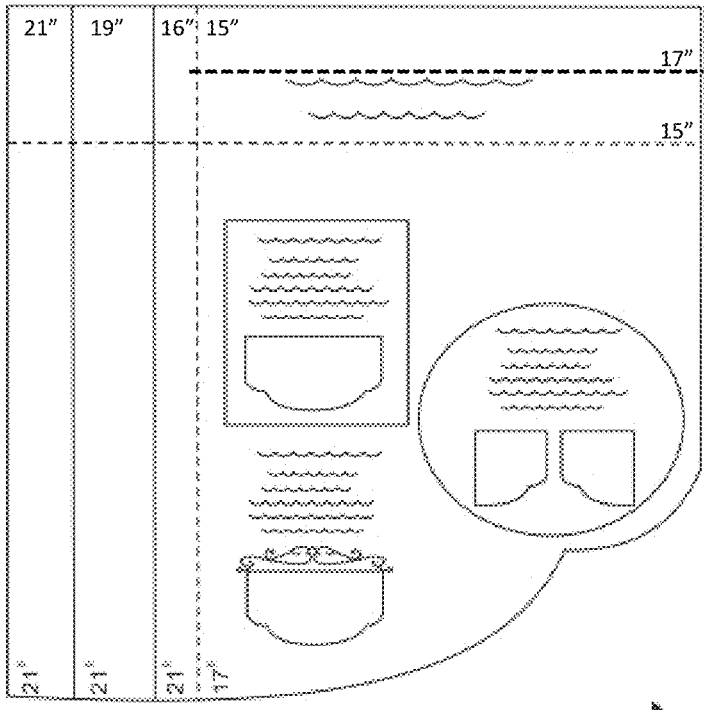
Figure 5D:
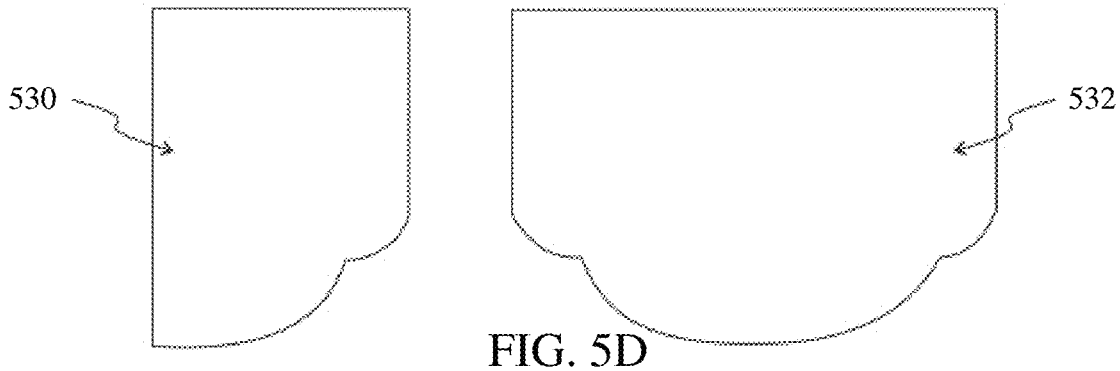

Referring now to FIG. 5C, illustrated is a design form 520 used for making the transfigure window valance 500. In one embodiment, the transfigure valance design form 520 combines both side panel and center panel form into one design form. Further, FIG. 5D illustrates a side panel 530 and a center panel 532 made using the design form 520 of the FIG. 5C.

The transfigure design form 520 provides sizing markers for creating three different side panels sizes. These sizes include, two small side panel 16", two 19" or two 21" side panel sizes. The 15" sizing marker is used to create the center panel which is the base for creating the particular designs.

Center and side panel combinations adjust to fit windows 32" to 54" wide, using a single center panel design. For windows 62" to 120" a connector panel (second center panel made by using sizing line 15", 16", 19" or 21" depending on window size) is used to adjoin two designs.

The transfigure design form 520 itself is 21" tall×21" wide. The 21" height is needed for creating a hanging pocket on the side panels. The 21" width is used to accommodate the different side and connector panel sizes. The finished side panels are 15" in height×the selected side panel size. The finished center panel is 17" in height×30", allowing for a 2" rod overlap for hanging.

Additionally, the design form base for the transfigure window valance 500 is specifically developed as a base shape for creating specific style forms. Further, the design base is formulated around the center panel shape. The sides of the finished panels adjust without distorting the design features. Strategically designed overlay accents are attached to the base panel in order to create specific designs. The style forms, specific to each design are included in the design kits. The style forms may come in four formats, namely, cut out, punch out, die cut and peel and stick. The peel and stick style forms are typically used when creating smaller patches that are difficult to trace. Moreover, each style form is printed with an assembly number. Some style forms are also marked to indicate the need for partial lining. The partial lining is attached to sections of the design that extend beyond the base panel edges. The fabric color, fabric shade and texture requirements are marked on each style form along with placement markers for the layered patches. Once created, the finished fabric patches are assembled and fused together by following the number and placement guide indicated in the style design guide and on the base design style forms.

Figure 6A:
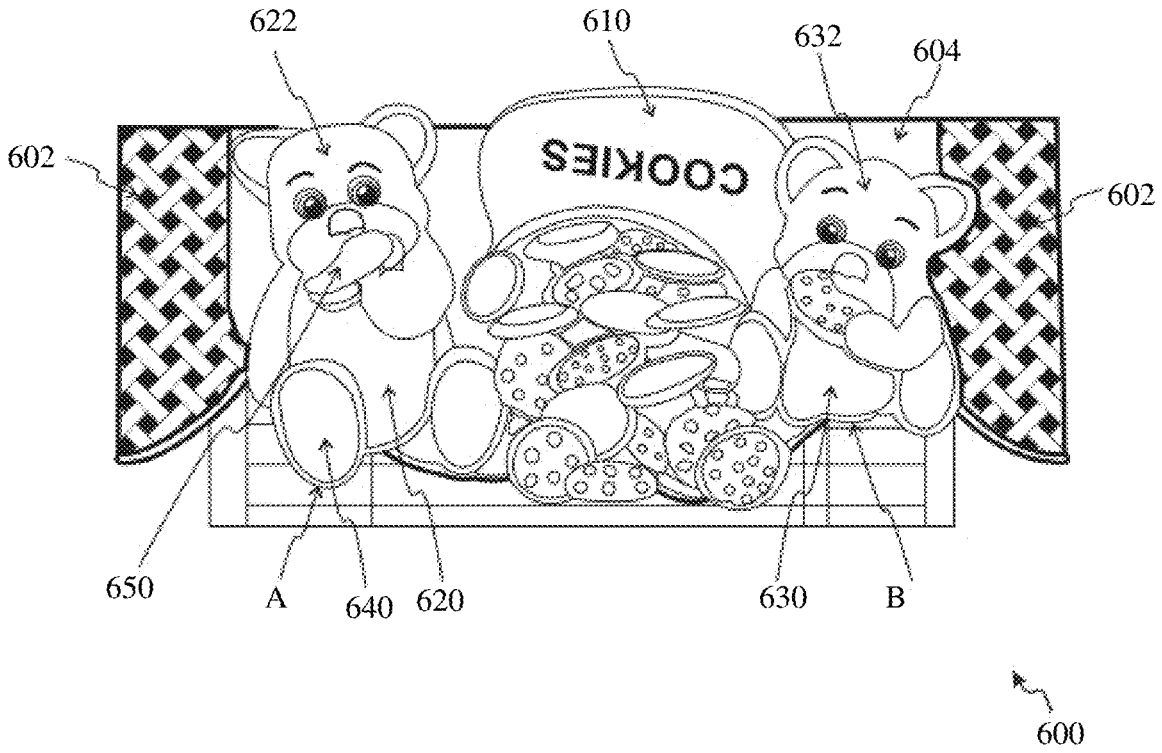
Figure 6B:
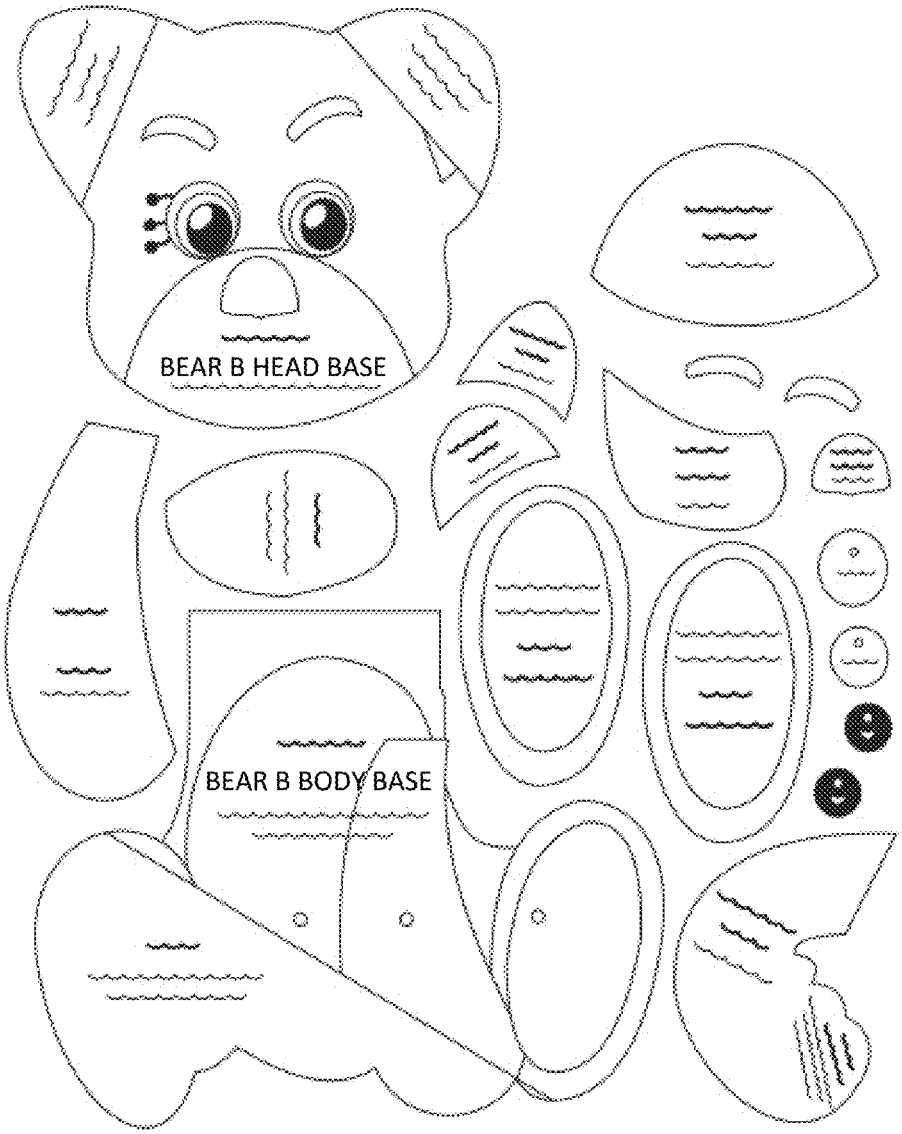

Referring now to FIG. 6A, another specific style form used to create "Paw in the Cookie Jar" design is shown for illustrating another transfigure window valance 600. For example, all required style forms are to be removed for each design and mock designs are then assembled for Bear A, Bear B and Cookie Jar (which is explained in greater detail later). The style forms are to be arranged on the "paper side" or "back side" of the fabric sections. Thereafter, the base style form (as shown in FIG. 6B) is used as a guide for assembling each section.

As shown in FIG. 6A, the transfigure window valance 600 includes side panels 602 and a center panel 604 adjoining the side panels 602. The center panel 604 also includes a theme, for example "Paw in the Cookie Jar". As shown, the theme includes a Bear A and Bear B.

The theme also includes the cookie jar 610 created using patches from folded fabric sections and serves as an anchor for the design placement. The patches are opened after cutting to create a full patch design. The placement markers for folded fabric are found on designated style forms. Extension lining is required on patches that "Pop Up" above the valance rod or extend beyond the base panel. Further, partial lining (or extension lining) is required to prevent sticking. Further, extension lining is attached before fusing designs to the base panel. The style forms also indicate extension lining numbers.

As shown, the theme includes the Bear A, which includes body 620 made by keeping the paper backing on Bear A and removing paper backing from patches. The body 620 includes a belly patch fused to the center of the body base and the base feet patches are fused, as instructed in FIG. 6B. The Bear A also includes a head 622 made by keeping paper backing on Bear A head base patch. The head 622 is made by removing paper backing from the face insert patch and fused to the bottom section of the head base patch. Further, the paper backing from ear insert patches and the nose patch are removed and fused to head base where indicated.

Similarly, the Bear B includes a body 630 made by keeping the paper backing on Bear B and removing paper backing from patches. The body 630 includes a belly patch which is fused to the center of the body base and the base feet patches are fused, as instructed in FIG. 6B. The Bear B also includes a head 632 made by keeping paper backing on Bear B. The head 632 is made by removing paper backing from the face insert patch and fused to the bottom section of the head base patch. Further, the paper backing from ear insert patches and the nose patch are removed and fused to head base where indicated.

As shown, the Bear A and Bear B include paws, such as a paw 640. The paw 640 in the theme is used keeping the paper backing on base patch and removing the paper backing from patches. The patches are fused to each other and the finished cookie jar 610 is then attached to the valance panel first.

Figure 6C:
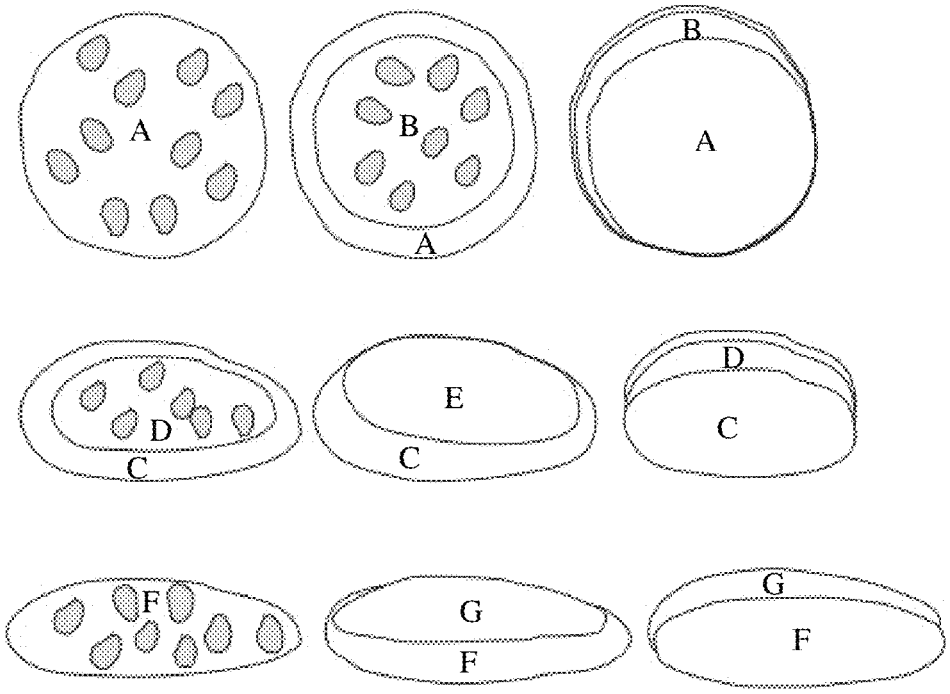
Figure 6D:
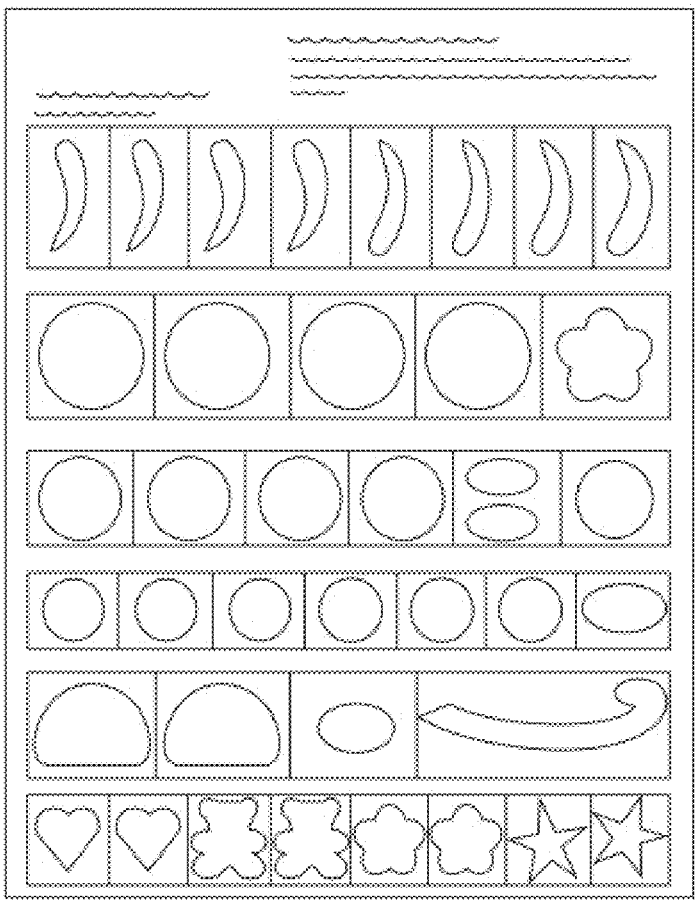

The theme also includes cookies held by bears, and is located on style form sheets positioned under bear paws. As shown, the Bear A holds a sandwich cookie 650 made using a darker brown fabric than the bear base fabric, with filling made using white lining. Both bear cookies have bite marks cut into the patch. The cookie bite marks style form is used to trace bite marks on the finished cookies. Specifically, the FIG. 6C shows the different forms of cookies, i.e. large (top row), medium (middle row) and small form (bottom row) and in various different perspectives. Further, the cookies may include different filling sandwiched between two cookie layers. For example, a top view of a cookie (depicted in the leftmost corner of the first row) shows a cookie layer 'A', upon removal of which a filling 'B' is exposed as shown in the middle section of the top row. A perspective view of the cookie with the two layers A and B is shown in the rightmost corner of the top row. Furthermore, FIG. 6C, shows various size cookies with different fillings (for example, filling 'D' and 'E', in the middle row and filling 'G' in the bottom row). The different varieties of cookies can be arranged in random order inside, and falling out of the cookie jar as shown in the theme.

The finished cookie jar 610 is positioned at an angle using the extension lining as a guide. The extension lining should fall just below where the panel will fold over the rod to prevent sticking. The cookie jar 610 should also extend 1" beyond the unfolded panel top edge. The left side of the jar side is positioned at 11" from the left panel edge, and 2½" up from the panel lower edge. The cookie jar 610 is fused to panel.

Further, Bear A is positioned to the left of the cookie jar. The extension lining is used as a guide to arrange the head & body on the panel. The bear head is placed over the body. The left ear is angled even with the panel top edge. The bear body will extend below the left side of the panel. The extension lining should position even with the lower edge. The left arm is positioned under the head with the paw tip just below the chin. The cookie is placed inside of the paw under the extension lined section. The mouth area is fused in place. The Bear B is positioned, to the right of the cookie jar, similarly as Bear A explained herein above.

The positioning of the bear eyes and eyebrows are of utmost importance to the overall charm and appeal of the creation. Specifically, FIG. 6D contains eye and eyebrow style forms from which peel and stick style forms can be chosen for creating desired types of expression. The colored dress lining is great for creating eye color, as it has some shine and will not fray. The light grey or tan for the eye base is used, dark green or blue for the eye color and black for the pupils adds to the charm.

Figure 6E:
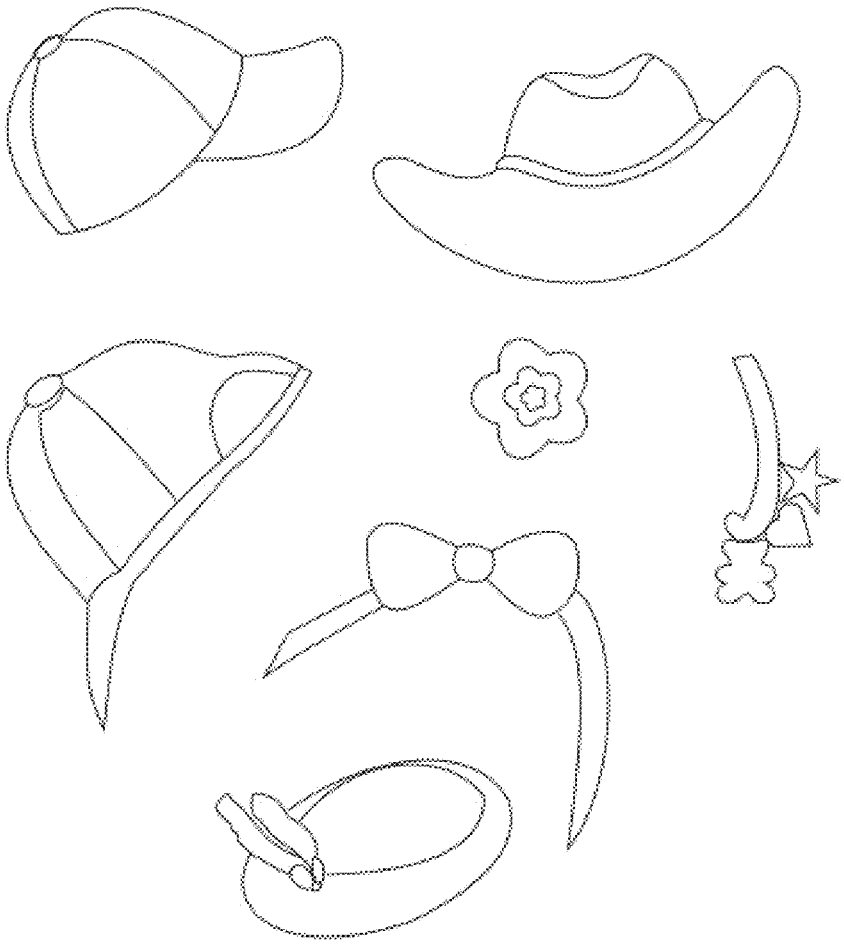

Referring now to FIG. 6E, custom accent style forms are displayed. As shown, the different types of custom accents include a Baseball Cap, a Cowboy Hat, a Mini/Hairband, a Bow/Flower and a Charm Bracelet. Further, the custom accents may be used to distinguish boy or girl bears. Moreover, to assemble accents, the matching numbered patches are layered to create the design piece.

The transfigure valence, such as transfigure window valance 600, is not limited to "Paw in the Cookie Jar design". The transfigure valence designs might be extended to coordinate room themes like cars, circus carousels and the like. Also, the transfigure valence designs may extend to traditional designs.

It may be evident that, the valance disclosed (scalloped window valance, arched window valance, straight window valance and transfigure window valance) herein includes a plurality of panels (side panels, center panels and connector panels), and such panels may be assembled using following steps:

At Step 1, fabric pieces are measured and cut into sized sections. The fabric is ironed to remove any wrinkles;

At step 2—fusible adhesive backing is cut to fit the section back side allowing for small margin around each edge. The backing is iron fused to the back side of each fabric section;

At step 3—paper from the fused backing is removed exposing the fused glue;

At step 4—lining is measured to fit the fabric section allowing for a small overlap of the entire piece of fabric. Lining is then iron fused to the exposed glue on the back of each panel section;

At step 5—the lined panel is folded in half;

At step 6—the valance design form is positioned over the folded fabric edge along the appropriate sizing line;

At step 7—the design form is traced around all edges except the folded edge;

At step 8—the panel is cut out and opened to create the completed panel;

At step 9—for attaching a second contrast fabric, the above process is repeated with the exception of the lining. This second panel is thus positioned over the base panel and iron fused to the panel; and At step 10—for fusing trim or fringe, the trim or fringe is attached using a glue gun. Fusible trim may also be attached to panel edges using an iron rather than a glue gun.

In one embodiment, the fabric to be used should be of 100% cotton and cotton blends, drapery fabrics and non—fray fabrics. In addition, any unlined cotton fabric items such as an extra drapery panel, cotton baby blanket, bed sheet, tablecloth and the like may be used to create panels. For example, solid fabrics for the valance center panel or wall accent panel are to be used. Further, 100% cotton lining and fusible backing is to be used. For example, strong hold double sided fusible adhesive backing may be used. Glue is applied onto the fabric back section in order to adhere lining to the panel sections. Further, flexible edge trim is used to finish panel edges and prevent fabric from fraying. As mentioned above, the trims are attached using two methods. The first method includes fusing the trim to the edges using an iron and the second method includes attaching the trim to the edges using a glue gun.

Once the valance of the present invention is made the valance may be hanged using a wide pocket rod. The 2" adhesive backed hook tape is used to attach to the back of the rod. Initially, required tape is calculated by measuring rod width plus 10" for returns. Thereafter, a piece of hook tape is cut to fit the adjusted rod length. Further, paper backing is removed, and the strip is attached to the rod back. The assembled rod is hanged. Once sized and hung on wall, cut two additional pieces of hook tape for the returns and attach to the assembled rod. The loop (soft side) adhesive tape is attached to the back of all valance center panels. Also, for center panels 1" (soft Side) loop tape attached to the lined side upper edge (back side) of the panels is used. The 1" Hook tape (hard side) is attached to back upper edge of the side panels and the front upper edge of the panels as a receiver for the loop tape when using layered panels in multi panel configurations. The rod requires 2" hook tape. The panels all receive 1" hook and loop tape. In case of 2" hook and loop tape it may be cut in half.

A 1" strip of fusible backing is cut and fused to the top back section of the lined valance center panel. Then, a strip of 1" "soft side" stick-on hook and loop tape is cut to fit the width of the center panel. The paper from the fused backing is removed. A section of paper from the stick-on tape is peeled back and the hook tape is secured in sections along the strip of exposed backing.

The valance configurations using multiple center panels requires both hard and soft hook and loop tape to be strategically placed to secure overlapped panels. Tape positioning is determined by the selected configuration. Large or small strips will be used as needed for panel expansion needs.

The valance of the present invention may be hanged using a method in which pockets are made in the side panels. This method of hanging includes following steps:

At step 1, side panel fabric is measured and cut into sized sections. The fabric is ironed to remove any wrinkles;

At step 2, fusible adhesive backing is cut to fit the fabric back up to the measurement line indicated on the design form, allowing for small margin around the outside and lower edges. The backing is iron fused to the back side of the side panel fabric section;

At step 3, paper from the fused backing is removed exposing the fused glue;

At step 4, lining is measured to fit the fabric section allowing for a small overlap of the entire piece of fabric. Lining is then iron fused to the exposed glue on the back of each panel section;

At step 5, the lined panel is folded in half;

At step 6, the valance design form is positioned over the folded fabric edge along the appropriate sizing line;

At step 7, the design form is traced around all edges except the folded edge;

At step 8, the panel is cut out and opened to create the completed panel. The side panels are cut in half down the center to create mirrored side panels before creating the hanging pockets;

At step 9, unlined fabric sections are folded over to the top line of the lining. For example, a 3" strip of backing is fused to the unlined folded fabric and a second 3" strip to the top section of the lined area. Also, paper is removed from both sections;

At step 10, the prepared unlined top 3" section is folded over the prepared lined 3" section and fused in place to create a pocket for hanging the side panel;

At step 11, two 1" wide strips of "hook" tape are cut for the back of the side panels. The length of the tape is determined by the degree of overlap from the center panel positioning;

At step 12, a strip of 1" piece of fusible backing is cut to the appropriate length and fused to the valance side panel back top edge beginning at the curved side. The 6" side return section will not receive fusible backing. A piece of "hard" side stick-on tape is cut based on the size of the backing section. The paper from the backing is removed and the "hard" side stick-on tape and the tape is secured to side panels. The "hard" tape on the back of the side panels is the receiving hook tape. It holds the center panel in place when rolled over the valance rod;

At step 13, the valance side panels are slid onto the rod and around the returns. The panel straight edges are positioned against the wall on each side;

At step 14, a 1" strip of fusible backing is cut and fused to the top back section of the lined valance center panel. A strip of 1" "soft side" stick-on hook and "loop" tape are cut to fit the width of the center panel. The paper from the fused backing is removed. A section of paper from the stick-on tape is peeled back and the hook tape is secured in sections along the strip of exposed backing;

At step 15, the center panel may be positioned over the side panels and the loop tape on the center panel is secured to the hook tape on the back side of each side panel and the valance rod. When multiple center panels are layered, the receiving "hard" side hook and loop tape is positioned on the upper front sides of the center panels in order to secure the panels to the back in areas (where the back rod hard tape is not exposed).

The present invention also provides wall accents, specifically; the present invention provides design kits used to create coordinated room theme accents including, wall accents. The accents are compatible with many traditional children's design themes. These home decor accents can be created economically without hiring a professional designer or having them custom made. The patch design number system allows even novice users to create elaborate "one of a kind" wall accents without the need for design skill. Further, numbered style forms are used to create accent designs using layered contrasting fabric sections. These designs may be made by creating patches and matching fabric pieces that assemble like a puzzle.

Each Children's Room theme design kit includes two or three compatible designs for use on multiple windows. For example, the children's kits may include 2-3 designs for use on multiple windows. These can be used individually or on one long window using a connector panel to adjoin the kids designs. These compatible designs can also be adjoined using a connector panel, and used across large window configurations. The center panel for each design also doubles as a wall accent. In addition, matching mini wall accent style forms are included in each kit providing a complete room design theme. For example, the mini wall accents can also be fused to any fabric item such as a pillow or a hamper for example.

In use, the wall accents may be attached to a wall using a ¼" strip of fusible backing to the top edge of the wall accent back lining side and rolled over to fuse creating a rod pocket. This creates a hanging pocket. For example, wall accent may be hanged using a tapestry rod or a pole, and ribbon or pegs may be used to pin panel directly to the wall. Additionally, a thin layer of repositionable adhesive may be sprayed to wall accents and attached to the wall. For example, the repositionable glue is used for the mini wall accents. Further, a hanging pocket may be created for a tapestry style wall accent. The hanging pocket is created by fusing a ¼" strip of fusible backing along the top edge of the back panel and then folding the top section over to fuse a rod pocket.

The present invention also provides table accent, particularly design kits for table accents. These table accent designs are compatible with the valance designs. Additionally, the themed table accent design kits may include holiday and zoo animal designs for example. These kits include style (or design) forms specific to each theme.

In one embodiment, an alternative would be to include both the valance/wall accent base panels and the die cut patches for creating the designs. Such kit would come complete with all fabric products to complete the designs. It is understood that any number of variations for the style forms or design fabric and/or patches may be created. In an embodiment, the design fabrics may be included in the kit. The design fabrics may be pre-treated with glue, and the paper side of the fabric may be printed with the numbered style form shapes. For this version, the fabric patches may be cut out, assembled and either fused or a peel and stick design assembly may be used. The design fabrics may be treated with a fusible glue or peel and stick fabric glue. In some embodiments, die cut patches may use peel and stick glue or fusible glue. Further, the kits may include all or part of—cut design fabrics (untreated or treated with fabric glue) along with all additional materials needed such as fusible backing, lining, hook & loop tape, trim etc. along with the design form and style forms needed to create the window or wall treatments.

The product could be packaged as a premade valance which would include two side panels and either a small or large center panel. Additional center panels may be sold separately depending on the size of the window or a plurality of panels may be included in the package to fit window sizes. The children's designs may include single designs to accommodate one window with the adjustable panels expanding from 32" to 56". Further, each package would include one connector panel for adjoining to a second design or compatible designs may also be packaged together and may/may not include mini wall accents. Further, the premade packaged product may also include premade attachable children's design themes that are secured to the base panel by using hook and loop tape or snaps, etc. This would allow the design to maintain the same signature look as the DIY versions of extending beyond the base panel and over the top of the rod. Further, the children's designs may also be sold as complete themed valance panels ready to hang.

The present invention provides a no sew, do it yourself (DIY) product that is a cross between a custom valance and a custom cornice, with and adjustable feature that allows for unlimited width. The decorative articles of the present invention require very little skill to create and provide very simple sizing lines. The valance panels may be created in two sections, side panels and center panels. The center panels are designed to link together and can be adjusted to expand across any size window while maintaining the individual design shape. The overlapped panels provide a tight custom fit, with a cornice style appearance. The option to add contrasting fabric on center panels, along with easy to attach trim and fringe, further add to the professional appearance of the finished valance. These features allow even novice users to create custom window treatments that do not require sewing skill or custom pattern knowledge. The window treatments of the present invention are far more detailed and unique than the packaged valance panels. The panels are very easy to hang and the overlapping panels attach to a standard metal wide pocket rod. Further, no valance board is required. Adjustable panels cover a wide range of window sizes without the need for precise measuring.

The present invention also addresses cost issue associated with the production of adjustable cornice line. The cornice style valance panels of the present invention are developed as a low-cost solution to the wood adjustable cornice. The design forms are similar in style to the cornices, and the overlapping panels emulate the look of the padded and covered cornice. The individual side and center valance panels are designed to overlap, accommodating the expansion needs. As mentioned above, the valance designs include three styles, scalloped, arched and straight. The fourth valance shape (transfigure design) was developed specifically for the children's designs. This design shape was created to use as a window valance, or as a tapestry style wall accent, when used without the side panels. Numbered style forms are created to further enhance these panels. The numbered style forms are developed to create fabric patches and are initially created for the children's styles, using the base transfigure design as a platform for the designs. The style form patch concept may be expanded to include traditional designs as well. These style forms are compatible with the traditional decorative styles, scalloped, arched and straight styles. These style forms may include designs such as flowers, fruit, garden designs and so on to be fused to the valance panels to enhance the designs. The straight design center panel may also be used to create a tapestry style wall accent. Further development of the style forms may result in mini wall accent designs. For example, these mini wall accents include a printed base style form, with placement lines for overlaid fabric patches to create the designs. These accents may be attached directly to the wall using repositionable glue or may be fused to any fabric item as a patch design.

The foregoing descriptions of specific embodiments of the present invention have been presented for purposes of illustration and description. They are not intended to be exhaustive or to limit the present invention to the precise forms disclosed, and obviously, many modifications and variations are possible in light of the above teaching. The example embodiment was chosen and described in order to best explain the principles of the present invention and its practical application, to thereby enable others skilled in the art to best utilize the present invention and various embodiments with various modifications as are suited to the particular use contemplated.

Accordingly, the disclosure of the present invention is intended to be illustrative, but not limiting, of the scope of the invention, which is set forth in the following claims.

The invention claimed is:

1. A method for making a cornice style window valance without sewing, the method comprising:

acquiring a kit that includes a plurality of design forms, wherein each of the plurality of design forms includes a traceable outer perimeter and a plurality of vertical panel sizing markers; and creating a plurality of panels using a single design form of the plurality of design forms to accommodate a particular window size, wherein creating the plurality of panels includes:

folding a fabric panel to create a folded edge, unfolding the fabric panel and aligning, with the single design form, a fusible adhesive layer, on a portion of a back side of the fabric panel, adding a backing to the back side of the fabric panel with the fusible adhesive layer, refolding the fabric panel with the backing along the folded edge, aligning the folded edge of the fabric panel with one of the plurality of vertical panel sizing markers on the single design form that indicates a desired size of one of the plurality of panels, tracing the traceable outer perimeter of the single design form, cutting the folded fabric panel along the tracing, and assembling the plurality of panels to create the cornice style window valance.

2. The method of claim 1, wherein each of the plurality of design forms are constructed from a semi-translucent material configured to be traced around the traceable outer perimeter, and wherein the semi-translucent material allows a print of the fabric panel to be seen through each of the plurality of design forms.

3. The method of claim 1, wherein the plurality of design forms include a first panel design form having a first shape, a second panel design form having a second shape, and a third panel design form having a third shape, the first shape being different from the second shape and the third shape, and the second shape being different from the third shape.

4. The method of claim 1, wherein creating the plurality of panels further comprises, after cutting the folded fabric panel along the tracing:

unfolding the cut out folded fabric panel to create at least one of the plurality of panels.

5. The method of claim 1, wherein the plurality of panels include at least one center panel and one or more side panels, and assembling the plurality of panels further comprises:

overlapping the at least one center panel over the one or more side panels.

6. The method of claim 1, wherein the portion of the back side of the fabric panel is a first portion delineated by the single design form, and creating the plurality of panels further comprises:

after cutting the folded fabric, forming a rod pocket on a back side of each of the plurality of panels in a second portion of the back side of the fabric panel delineated by the single design form, wherein the second portion is separate from the first portion and the rod pocket can move freely on a curtain rod when the fabric panel is installed thereon.

7. The method of claim 1, wherein at least a portion of the traceable outer perimeter of at least one of the plurality of design forms has a scalloped shape.

8. The method of claim 1, wherein the plurality of vertical panel sizing markers include at least:

a first vertical panel sizing marker disposed a first distance from a first side of at least one of the plurality of design forms; and a second vertical panel sizing marker disposed a second distance from the first side of the at least one of the plurality of design forms, the second distance being greater than the first distance;

wherein creating the plurality of panels using at least one of the plurality of design forms further comprises sliding the at least one of the plurality of design forms over the folded fabric panel to align the folded edge with a desired one of the first vertical panel sizing marker or the second vertical panel sizing marker prior to tracing along the traceable outer perimeter of the at least one of the plurality of design forms.

9. The method of claim 1, wherein at least a portion of the traceable outer perimeter of at least one of the plurality of design forms has an arched shape.

10. The method of claim 1, wherein at least a portion of the traceable outer perimeter of at least one of the plurality of design forms has a straight line shape.

11. The method of claim 1, wherein the plurality of panels include at least two center panels, at least one connector panel, and one or more side panels, and assembling the plurality of panels further comprises:

overlapping a first center panel of the at least two center panels over a first side panel of the one or more side panels and the at least one connector panel; and overlapping a second center panel of the at least two center panels over the at least one connector panel.

12. A kit for making a cornice style window valance without sewing, the kit comprising:

a plurality of design forms, each of which creates, on its own, a plurality of panels of the cornice style window valance, and each design form of the plurality of design forms includes:

a traceable outer perimeter, a plurality of vertical panel sizing markers, each vertical panel sizing marker being representative of a specific size of a panel of the plurality of panels of the cornice style window valance, and a horizontal lining marker that delineates a first portion of a fabric on which a backing can be placed to create the panel and delineates a second portion of the fabric needed on the panel to create a rod pocket for the panel that can move freely on a curtain rod when panel is installed thereon; and a fusible adhesive layer configured to be fused to a back side of the fabric in the second portion so that a backing can be added to the back side of the panel in the second portion, wherein the fusible adhesive backing is aligned on the fabric with a single design form of the plurality of design forms after folding and unfolding the panel and, subsequently, the backing and the fabric are refolded and cut along a line traced with the single design form to create the panel.

13. The kit according to claim 12, wherein the traceable outer perimeter further comprises:

at least one vertical portion having a bottom end and a top end;

at least one horizontal portion having a first end and a second end, the first end of the at least one horizontal portion being coupled to the top end of the at least one vertical portion, the at least one horizontal portion extending horizontally from the top end of the at least one vertical portion; and at least one third portion extending in a predefined shape from the second end of the at least one horizontal portion to the bottom end of the at least one vertical portion.

14. The kit according to claim 13, wherein the predefined shape includes a scalloped shape.

15. The kit according to claim 13, wherein the predefined shape includes an arched shape.

16. The kit according to claim 13, wherein the at least one vertical portion is a first vertical portion and the at least one horizontal portion is a first horizontal portion, and wherein the predefined shape includes:

a second vertical portion opposite the first vertical portion and descending from the second end of the first horizontal portion;

a second horizontal portion opposite the first horizontal portion and extending from the bottom end of the first vertical portion; and a curved portion coupled to the second vertical portion and the second horizontal portion.

17. The kit according to claim 13, wherein the plurality of vertical panel sizing markers include:

a first vertical panel sizing marker disposed a first distance from the at least one vertical portion of the traceable outer perimeter; and a second vertical panel sizing marker disposed a second distance from the at least one vertical portion of the traceable outer perimeter, the second distance being greater than the first distance.

18. The kit according to claim 12, wherein each of the plurality of design forms is constructed from a semi-translucent material configured to be traced around the traceable outer perimeter.

* * * * *